US006655097B1

(12) United States Patent
Poolaw

(10) Patent No.: US 6,655,097 B1
(45) Date of Patent: Dec. 2, 2003

(54) METHOD AND APPARATUS FOR MAINTAINING A COLUMN IN AN UPRIGHT POSITION

(76) Inventor: Billy E. Poolaw, 4517 NE. Highlander Cir., Lawton, OK (US) 73501

( * ) Notice: Subject to any disclaimer, the term of this patent is extended or adjusted under 35 U.S.C. 154(b) by 0 days.

(21) Appl. No.: 10/109,292

(22) Filed: Mar. 28, 2002

(51) Int. Cl.[7] ..... E04G 21/26; E04H 12/20; F16M 11/20; A47B 97/00

(52) U.S. Cl. ..... 52/127.2; 52/146; 248/188.1; 248/507

(58) Field of Search ..... 52/127.1, 127.2, 52/146; 248/188.1, 188.5, 507

(56) References Cited

U.S. PATENT DOCUMENTS

| | | | | | |
|---|---|---|---|---|---|
| 1,473,054 | A | * | 11/1923 | Smith | 52/117 |
| 3,605,359 | A | * | 9/1971 | Bader | 52/146 |
| 4,068,427 | A | * | 1/1978 | Camardo | 52/127.2 |
| 5,287,781 | A | * | 2/1994 | Fehr et al. | 83/155 |
| 5,494,333 | A | * | 2/1996 | Wilson | 297/344.18 |
| 5,537,125 | A | * | 7/1996 | Harrell et al. | 343/878 |
| 5,715,658 | A | * | 2/1998 | Citron et al. | 53/492 |
| 5,733,092 | A | * | 3/1998 | Barry | 414/337 |
| 5,735,034 | A | * | 4/1998 | Citron et al. | 29/407.09 |
| 5,865,014 | A | * | 2/1999 | Citron et al. | 53/492 |
| 6,230,448 | B1 | * | 5/2001 | Oliver et al. | 52/126.7 |

FOREIGN PATENT DOCUMENTS

| | | | |
|---|---|---|---|
| FR | 2 577 302 | * | 2/1985 |
| JP | 6185112 | * | 7/1994 |

* cited by examiner

*Primary Examiner*—Carl D. Friedman
*Assistant Examiner*—Kevin McDermott
(74) *Attorney, Agent, or Firm*—Thomas R. Weaver

(57) ABSTRACT

An apparatus and a method of using the apparatus to temporarily support a utility pole is disclosed. The apparatus is comprised of a plurality of structural elements which are hinged together to form an articulated frame. The frame is adapted to be connected to a pole and caused to conform to the slope or angle of the pole with respect to the ground. The frame is also adapted to conform to the slope of the ground in which the pole is embedded. The articulated frame of this invention finds particular utility in supporting a utility pole installed in ground subject to collapse due to excavation in the vicinity of the pole. In this regard, the frame is useful to obviate the need to temporarily reroute a power line erected in the vicinity of earth removal operations.

10 Claims, 8 Drawing Sheets

METHOD AND APPARATUS FOR MAINTAINING A COLUMN IN AN UPRIGHT POSITION

BACKGROUND OF THE INVENTION

1. Technical Field of the Invention

This invention broadly relates to structural frames. This invention further relates to structural frames which can be employed to stabilize an existing structure. This invention still further relates to a portable jointed frame which can be erected on site to temporarily support an existing structure. This invention more particularly relates to an articulated portable frame and the method of using it to maintain a utility pole in an upright position.

2. Description of the Prior Art and Problems Solved

Electric utility companies, and other entities, erect structures, for example substantially vertical columns of relatively small diameter, such as long wooden poles, to support overhead wire and cable employed to conduct electricity and data. It is known that such wire and cable include power lines, telephone lines, television cable and the like. It is also known that any interruption in the services provided by such wire and cable can result in customer ill will, aggravation and annoyance as well as considerable inconvenience and outright danger to persons and institutions who depend upon and otherwise rely on the services. In short, services provided by power lines and data transmission cable constitute a virtually essential aspect of the conduct of business and the safety and enjoyment of life by persons and other users of the services.

Interruption of power and data transmission services can and does occur on an unplanned and surprise basis. Examples of such interruptions are well known to be caused by natural events, such as storms, floods and fire. Surprise interruptions in service can also be caused by accidents, such as a car wreck wherein a pole is knocked down. Service providers treat unplanned interruptions as an emergency and work diligently to restore service as quickly as possible. Customers and other users have developed, at least, a limited tolerance of unplanned interruptions with the expectation and understanding that efforts are underway to remedy the problem.

In contrast, interruptions which can be foreseen by service providers are not received by customers with the same tolerance as unplanned interruptions. Consequently, service providers exert great efforts to avoid service interruptions which can be foreseen. An upright pole which can fall if soil which supports the pole is removed during a construction operation can be the cause of an interruption in electric service which can be foreseen.

In operations which involve the removal of soil from the vicinity of an upright pole, or from the vicinity of a line of upright utility poles, the possibility of undermining the pole with the result that the pole can fall and cause a service interruption can be foreseen. Such undermining can be caused by digging ditches, excavating roadbeds or similar earth removal activities at points very close to a pole or poles. With the foreseeable service loss in mind, service providers and earth removal entities, to avoid interruption and the adverse consequences of a service loss and the consumer ire that such a loss would cause, temporarily reroute :service lines before excavation begins. Following the completion of construction operations, the original route is restored. The current practice of temporarily rerouting followed by restoring the original route is time consuming and expensive.

There, thus, exists a need of an apparatus and a method of using the apparatus which functions to prevent an upright column, such as an electric utility pole, from falling if removal of soil in the vicinity of the column would undermine the column and cause it to fall. Use of the apparatus, or of a plurality of such devices, would obviate the need to temporarily reroute a line of utility poles to avoid an interruption in service.

THE INVENTION

1. DISCLOSURE OF THE INVENTION

By this invention there is provided an apparatus and a method of using the apparatus to support a column, such as an electric utility pole, in an upright position. An electric utility pole is, ideally, plumb. Such a pole may, in fact, have been plumb when first installed in the ground, but a pole, over the passage of time, can lean out of plumb while still remaining in an "upright position." Furthermore, since ground having a pole installed therein is not necessarily horizontal, such a pole installed in the ground, even if plumb at the time of installation, is not necessarily perpendicular to the ground in which it is installed, but is, nevertheless, in an "upright position." Accordingly, for purposes of this invention, the phrase "upright position" means a position occupied by a pole which is not lying on the ground, but which is not necessarily plumb or perpendicular to the ground in which it is installed. It follows, then, that an apparatus whose function it is to support a pole in an "upright position" must operate in environments wherein the pole may lean out of plumb and/or wherein the pole is not perpendicular to the ground in which the pole is installed. The apparatus of this invention is, thus, a frame which is deliberately articulated to enables it to support a pole in an upright position even if the pole is not plumb and/or is not perpendicular to the ground in which the pole is installed.

This invention finds particular utility in the situation wherein a pole installed in ground in the vicinity of earth to be removed may fall if earth essential to the support of the pole is removed. Use of this invention will prevent the pole from falling even if the earth required to support the pole is removed from the vicinity of the pole.

In accordance with the method of this invention, an articulated frame comprised of a pole contacting element, a primary ground contacting element and at least one rigid stiffening element is provided, placed and held against the pole to be supported. The pole contacting element is attached to the primary ground contacting element by a pivot connection and by the rigid stiffening element. In operation, the frame is positioned so that the ground contacting element is placed on earth which will not be removed, and the pole contacting element is placed in contact with the pole and oriented so that the linear axis of the pole contacting element is substantially parallel to the linear axis of the pole. The pole contacting element is then urged and held against the pole to create frictional resistance between the pole and the pole contacting element sufficient to prevent the pole from sliding against the pole contacting element. Thereafter, the ground contacting element and the pole contacting element are connected by the rigid stiffening element to force the ground contacting element against the ground in which the pole is installed to thereby prevent any movement between the ground contacting element and the pole contacting element at the mentioned pivot connection. Thereafter, earth removal may begin.

Additional ground contacting elements can be attached by pivot connections to the primary ground contacting element, and additional stiffening elements can be attached to such additional ground contacting elements to rigidly connect them to the pole contacting element.

In another aspect, an anchored flexible line, such as a cable or a chain, can be vertically suspended from the articulated frame and attached to the pole to be supported to help prevent sliding movement between the pole and the pole contacting element.

The nature and content of the pole contacting element, the ground contacting elements the stiffening elements and the flexible line, as well as the method of their use and operation, are more particularly described in the following text and drawings.

2. BRIEF DESCRIPTION OF THE DRAWINGS

FIG. 4 does show the primary support leg, but does not show the secondary support leg.

FIG. 5 does show the secondary support leg, but does not show the primary support leg.

FIG. 6 shows the connections of the secondary support leg and the left support leg to the distal end of the upright member.

FIG. 7 shows the connection of the secondary support leg to the front end of the secondary base member.

FIG. 8 shows the roller bar attached to the distal end of the upright member.

3. DESCRIPTION OF THE PREFERRED EMBODIMENTS

Figure 1:
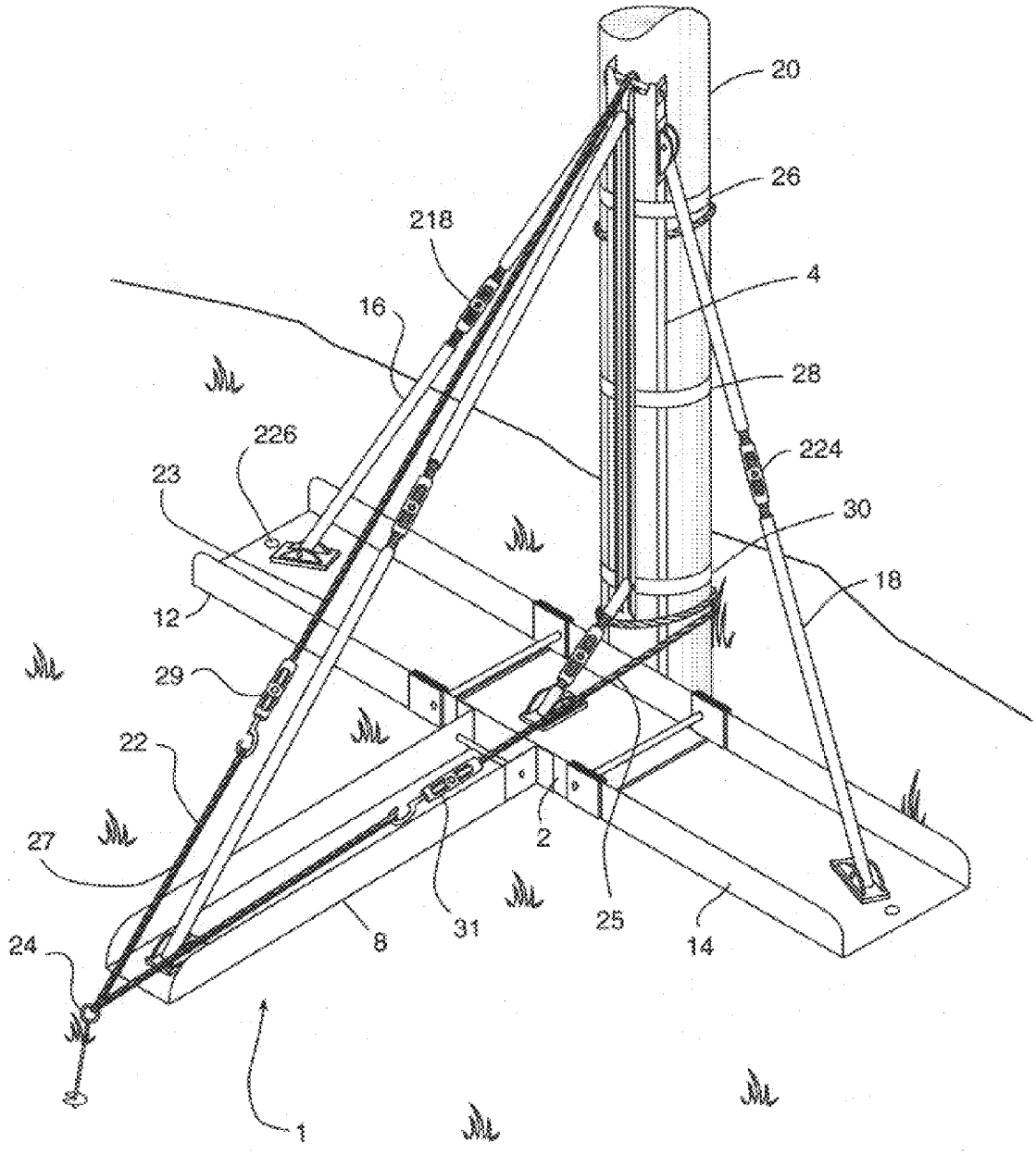
FIG. 1 is an artist's rendition of one embodiment of the apparatus of this invention as used to maintain a column, such as an electric utility pole, in an upright position.

Referring now to FIGS. 1–15, and particularly to FIGS. 1–5, 9 and 10, the apparatus of this invention, an articulated frame useful to maintain a pole in an upright position, is generally designated by reference numeral 1. In one embodiment, frame 1 is functionally comprised of a primary ground contacting element, shown in the drawings as first base member 2, the primary base member; a pole contacting element, shown in the drawings as upright member 4; and a stiffening element, shown in the drawings as first support leg 6, the primary support leg. In another embodiment, frame 1 is further comprised of second base member 8, the secondary base member, and second support leg 10, the secondary support leg. In still another embodiment, frame 1 is still further comprised of third base member 12, the left base member; fourth base member 14, the right base member; third support leg 16, the left support leg; and fourth support leg 18, the right support leg. In a still further embodiment, frame 1 can still further comprise tension member 22, anchor 24, and compression bands 26, 28 and 30 to assist the articulated frame of this invention to maintain a column, such as utility pole 20, in an upright position. It is to be understood that the identified base members and the upright member are rigid elements, which, upon inclusion in frame 1, can pivot at the point or points of connection each to the other. It is also to be understood that the identified legs are rigid elements which operate as stiffening members to prevent, or at least to substantially reduce, pivoting movement between the connected base members and the upright member.

Figure 14:
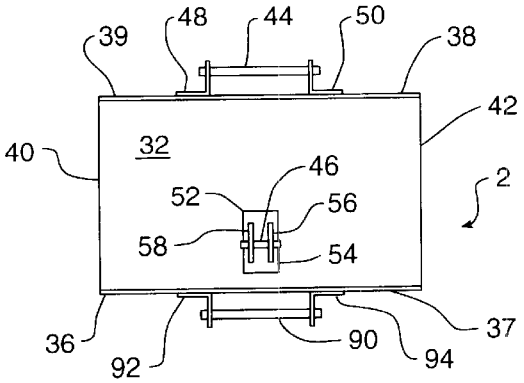
FIG. 14 is the top view of the primary base member of the apparatus of this invention.
Figure 15:
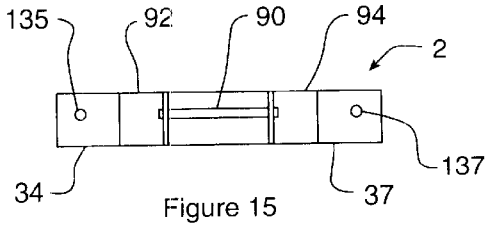
FIG. 15 is the front view of the primary base member shown in FIG. 14.

Having identified the principle structural elements of frame 1, please refer to FIGS. 14 and 15 and observe that primary base member 2 is a first workpiece substantially in the shape of a channel having a linear axis, a transverse axis, a web, comprising upper surface 32 and lower surface, 34, front flange 36, having outer surface 37, back flange 38, having outer surface 39, left end 40, right end 42, upright axle 44, adapted for removable attachment to outer surface 39, and primary base axle 46, adapted for removable attachment to upper surface 32. Each of flanges 36 and 38 is substantially parallel to the linear axis of base member 2 and each extends upwardly from and substantially perpendicular to upper surface 32. For purposes of definition, surface 37 is the front side of base member 2 and surface 39 is the back side of base member 2.

Upright axle 44 is removably attached to back surface 39 by means of right angle clips 48 and 50, each of which is attached to surface 39 at points intermediate left end 40 and right end 42 of base member 2. The first leg of each of clips 48 and 50 is rigidly attached to surface 39 whereby the second leg of each of clips 48 and 50 extends outwardly from, and substantially perpendicular to surface 39. A hole, not shown, penetrates the mentioned second leg of each of clips 48 and 50. The holes in clips 48 and 50 are in alignment, are sized to rotatably receive and support each end of axle 44 and positioned to place axle 44 a constant distance from surface 39 and substantially parallel to the linear axis of base member 2.

Primary base axle 46 is removably attached to upper surface 32 of base member 2 by means of clip assembly 52. Clip assembly 52 is rigidly attached to surface 32 at a point intermediate left end 40 and right end 42. Clip assembly 52 is preferably aligned along the transverse axis of base member 2 and positioned equidistant between clips 48 and 50. Clip assembly 52 is comprised of plate 54 having rigidly attached thereto ears 56 and 58, each of which extend upwardly from and substantially perpendicular to plate 54 and parallel to the transverse axis of member 2. A hole, not shown, penetrates each of ears 56 and 58. The holes in ears 56 and 58 are in alignment, are sized to rotatably receive and support each end of primary base axle 46 and positioned to place axle 46 a constant distance from surface 32 and substantially parallel to upright axle 44.

Please refer to FIGS. 8, 9, 10 and 11, and observe that upright member 4 is a second workpiece substantially in the shape of a channel having first proximal end 60, adapted for rotatable connection to upright axle 44, first distal end 62, a linear axis, a transverse axis, web 63, comprising front side 64 and back side 66, left side flange 68, and right side flange 70. Cavity 65 is, thus, formed in the space bounded by flanges 68 and 70 and back side 66.

Hole 61 penetrates flange 68 adjacent proximal end 60 of upright member 4. A hole, not shown, which is in alignment with hole 61, penetrates flange 70. The aligned pair of holes, referred to as holes 61, are adapted to rotatably receive and support the ends of upright axle 44.

Figure 3:
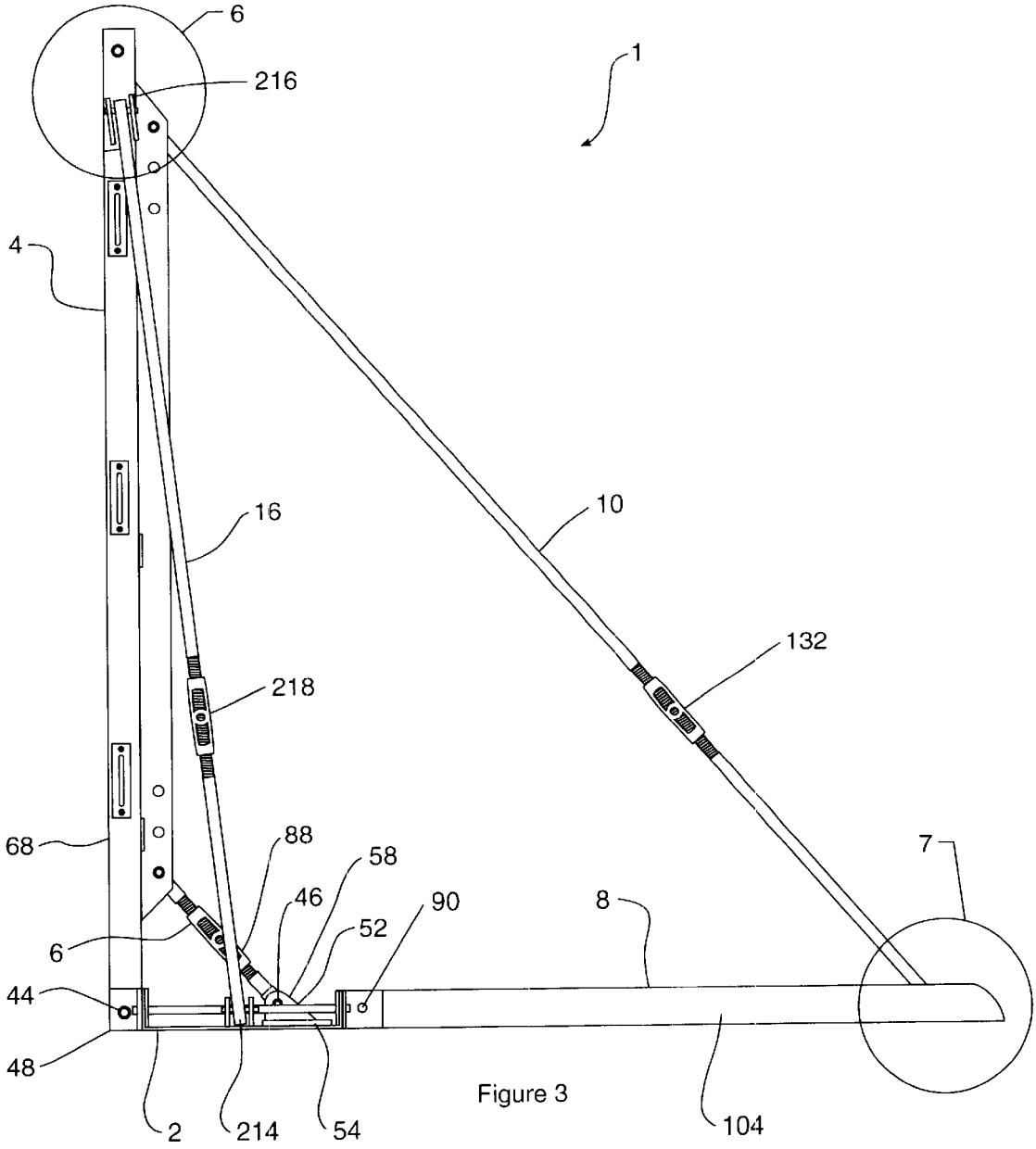
FIG. 3 is the left side view of the apparatus shown in FIG. 2.
Figure 4:
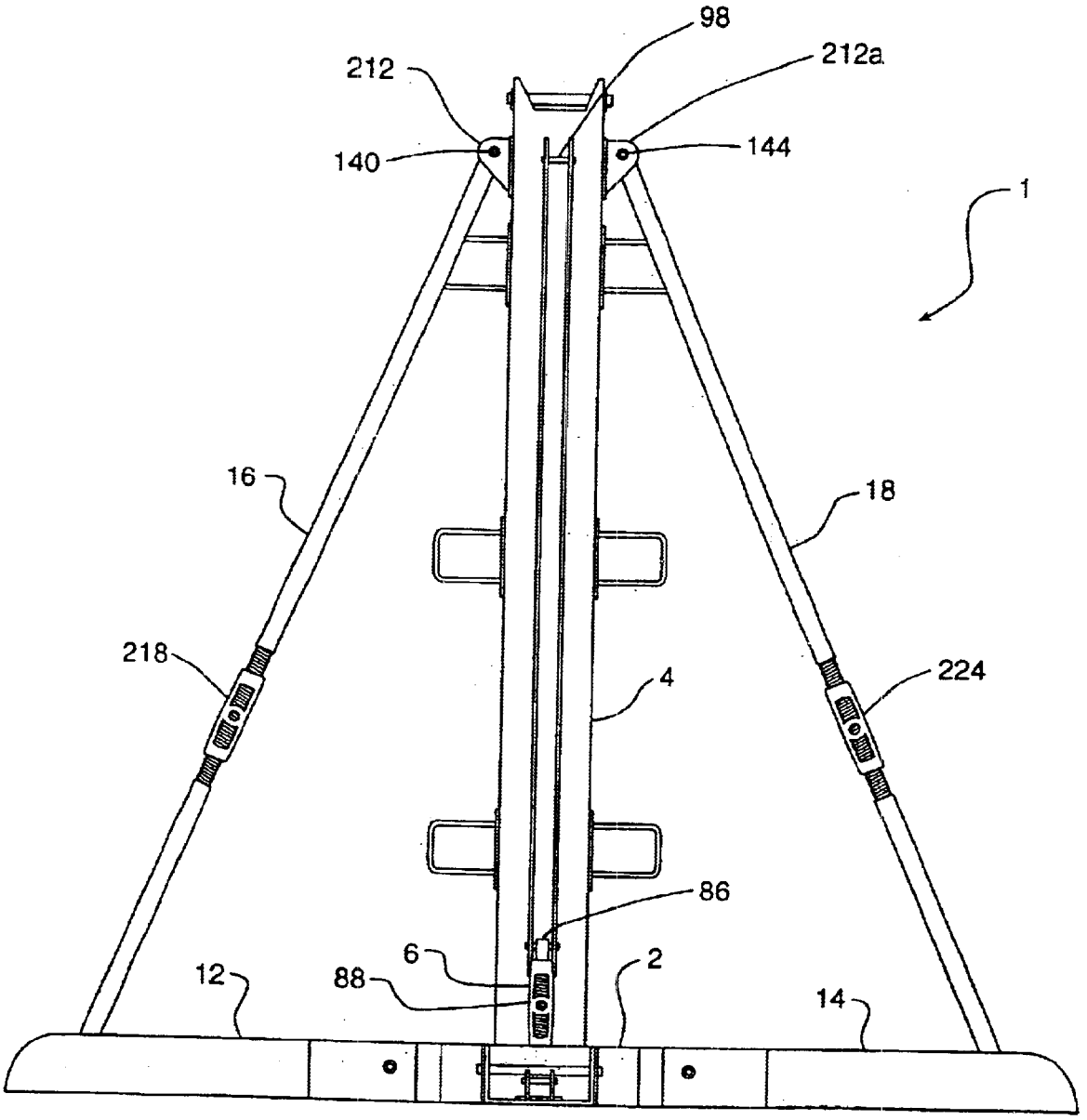
FIG. 4 is a modified front view of the apparatus shown in FIG. 2.
Figure 5:
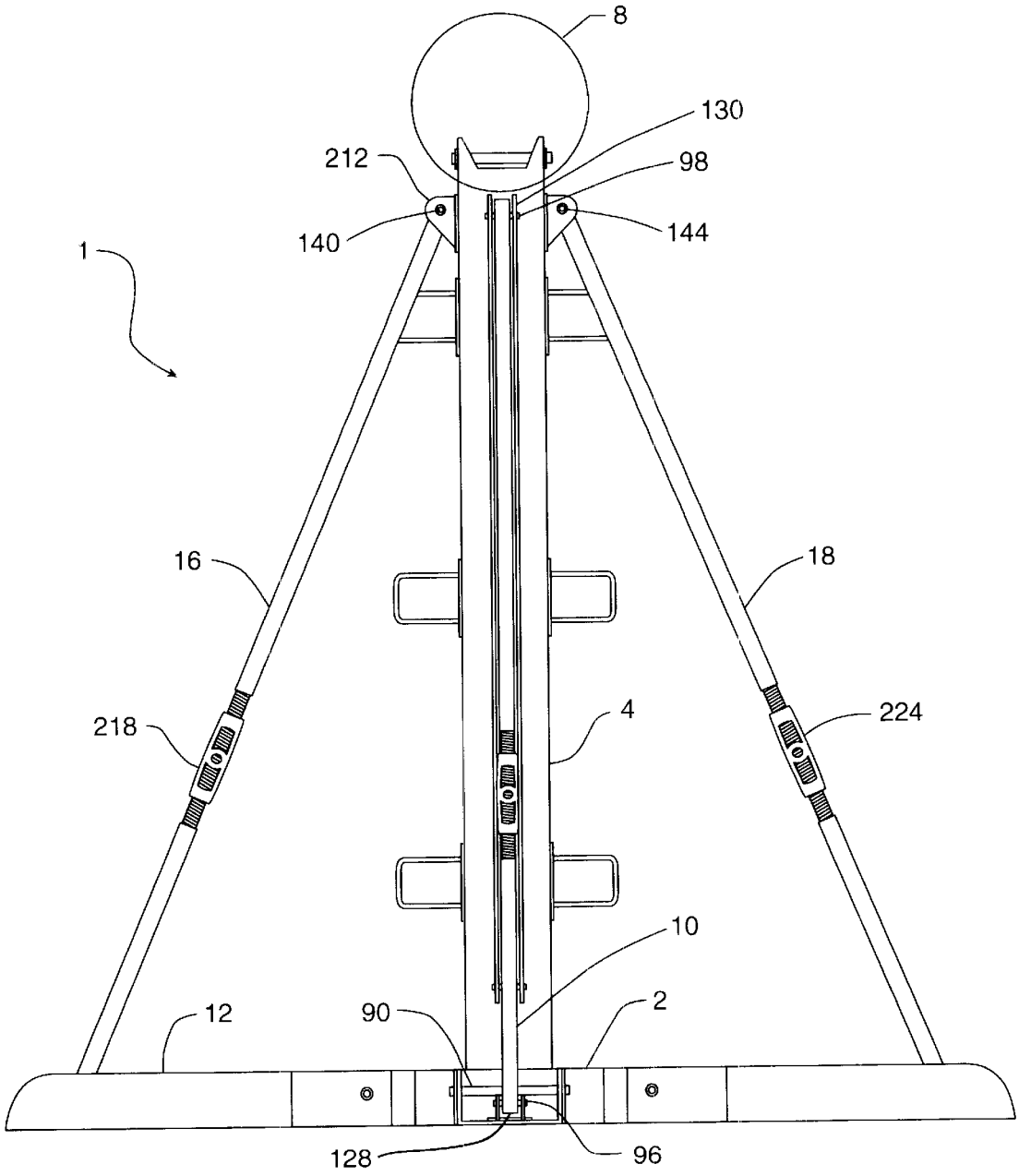
FIG. 5 is a modified front view of the apparatus shown in FIG. 2.
Figure 6:
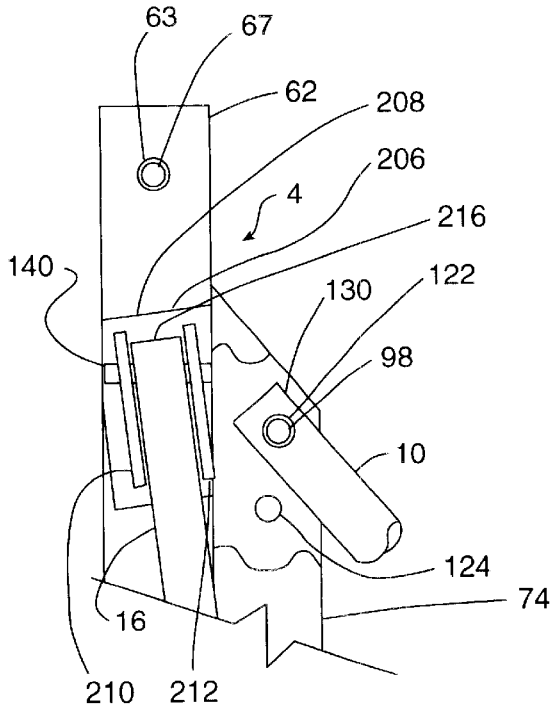
FIG. 6 is a fragmentary view of the portion of FIG. 3 enclosed within circle 6.
Figure 7:
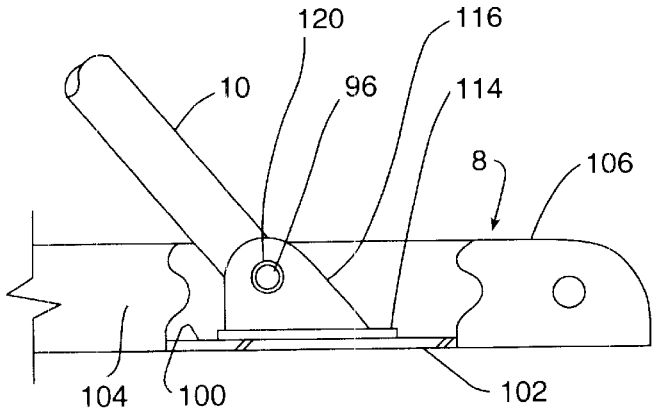
FIG. 7 is a fragmentary view of the portion of FIG. 3 enclosed within circle 7.
Figure 8:
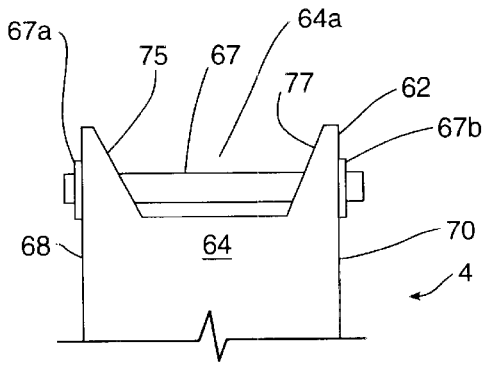
FIG. 8 is a fragmentary view of the portion of FIG. 5 enclosed within circle 8.
Figure 9:
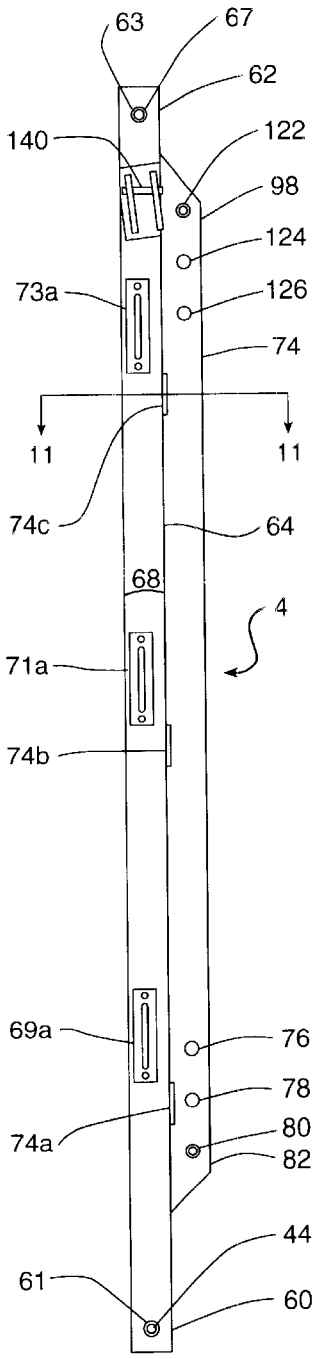
FIG. 9 is the left side view of the upright member of the apparatus of this invention.

The separation between flange 68 and flange 70 is adjusted to enable slidable insertion of flanges 68 and 70 between clips 48 and 50 which, as mentioned, are connected to surface 39 of primary base member 2. Upon insertion of flanges 68 and 70 between clips 48 and 50, holes 61 are aligned with the previously described holes in the second legs of clips 48 and 50. As shown in FIGS. 3 and 9, axle 44 is then inserted into the thus aligned holes to thereby rotatably connect front side 64 of upright member 4 at proximal end 60 to back surface 39 of primary base member 2.

Ribs 72 and 74 are rigidly attached to front side 64 of upright member 4 intermediate and parallel to flanges 68 and 70. Ribs 72 and 74 extend outwardly from and perpendicular to front side 64.

As disclosed above, upright member 4 is rotatably connected to primary base member 2 wherein, upon such connection, rib 72 preferably lies in the same plane as ear 56 which is attached to surface 32, and rib 74 preferably lies in the same plane as ear 58 which is also attached to surface 32. Accordingly, the separation between ribs 72 and 74 is preferably equal to the separation between ears 56 and 58.

Holes 76, 78 and 80 penetrate rib 74 adjacent proximal end 60 of upright member 4. Holes, not shown, which are in alignment with holes 76, 78 and 80 penetrate rib 72. The three aligned pairs of holes, referred to as holes 76, 78 and 80, are adapted to rotatably receive and support the ends of primary leg axle 82 which is adapted to be inserted into and rotatably supported by holes 76, 78 and 80. Primary leg axle 82 can be, thus, removably attached to front side 64 of upright member 4 intermediate first proximal end 60 and first distal end 62. Axle 82 is positioned a constant distance from front side 64 and substantially parallel to upright axle 44 which is attached to back surface 39 of primary base member 2.

Hole 63 penetrates flange 68 adjacent distal end 62 of upright member 4. A hole, not shown, which is in alignment with hole 63, penetrates flange 70. The aligned pair of holes, referred to as holes 63, are adapted to receive and support the ends of a bar, such as roller 67, which is adapted to rotate in holes 63. Rings 67*a* and 67*b* retain roller 67 in holes 63. A portion 64*a* of web 63 of upright member 4 at distal end 62 is shaped to expose roller 67 in cavity 65 as roller 67 extends between flange 68 and flange 70. The surface of roller 67 and opposite sides 75 and 77 of portion 64*a* of web 63 cooperate to guide and maintain a flexible line, cable or chain, such as tension member 22, on roller 67 as the line passes over roller 67 and into cavity 65.

Figure 11:
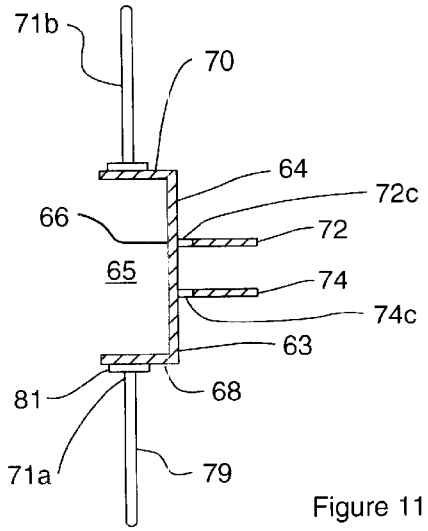
FIG. 11 is a cross-sectional view of the upright member shown in FIG. 9 taken in the direction of cut-line 11.
Figure 12:
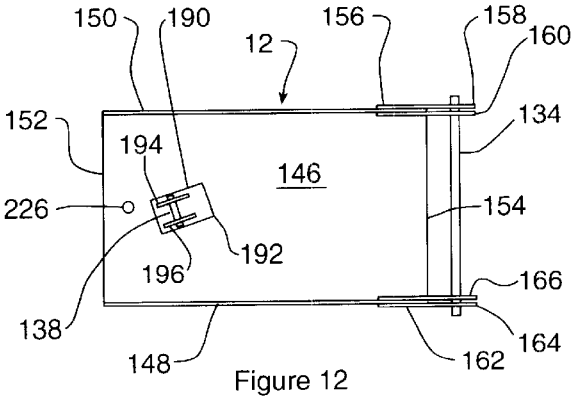
FIG. 12 is the top view of the left base member of the apparatus of this invention.
Figure 13:
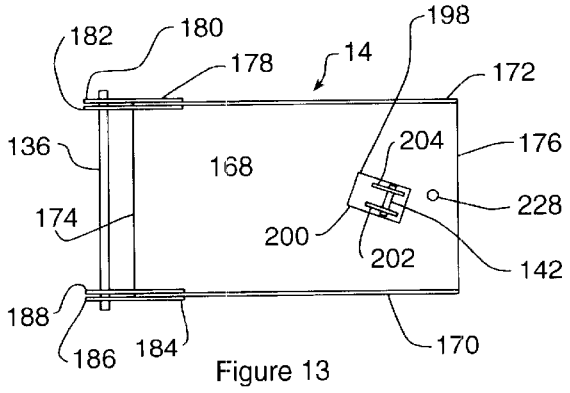
FIG. 13 is the top view of the right base member of the apparatus of this invention.
Figure 10:
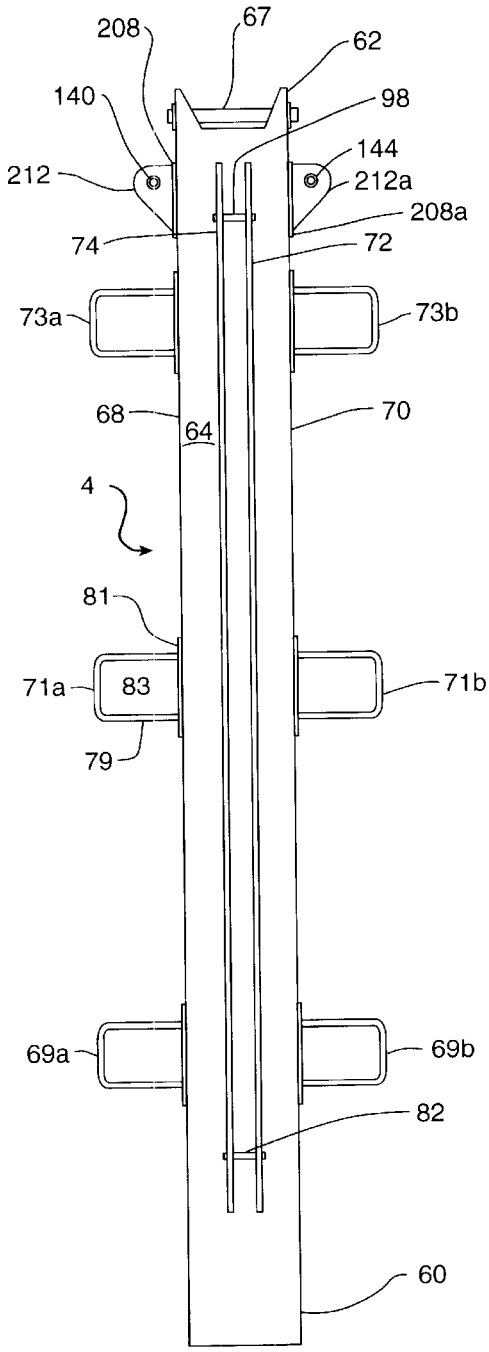
FIG. 10 is the front view of the upright member shown in FIG. 9.

Hand and foot support brackets 69*a*, 71*a* and 73*a* are spaced apart and perpendicularly installed on flange 68. Hand and foot support brackets 69*b*, 71*b* and 73*b* are spaced apart and perpendicularly installed on flange 70. The brackets, as shown in FIGS. 10 and 11 are aligned in pairs. As seen in FIGS. 10 and 11, each bracket is comprised of a "U"-shaped bar 79, the ends of which are rigidly attached to rectangular plate 81. Bar 79 and plate 81 cooperate to form open space 83. Bar 79 and the linear axis of plate 81 are positioned in alignment with the linear axis of upright member 4.

Slots 74*a*, 74*b* and 74*c* are formed in rib 74 at the intersection surface 64 and rib 74. The slots are spaced along rib 74 intermediate proximal end 60 and secondary leg axle 98. Slots 72*a*, 72*b* and 72*c* are formed in rib 72 at the intersection surface 64 and rib 72 and are in alignment with slots 74*a*, 74*b* and 74*c*, respectively. The combination of each aligned pair of slots, such as slots 72*c* and 74*c*, as shown in FIG. 11, permit access from flange 68 to flange 70 along surface 64 without crossing over the outer edges of ribs 72 and rib 74.

Primary support leg 6 is a linear member having first connecter 84, not shown, at one end thereof adapted for rotatable connection to primary base axle 46, and second connecter 86 at the other end thereof adapted for rotatable connection to primary leg axle 82. It is, thus, clear that a hole, not shown, penetrates first connector 84 wherein the hole is of diameter sufficient to enable primary base axle 46 to slidably pass through the same and to permit support leg 6 to rotate around axle 46. It is also clear that a hole, not shown, penetrates second connector 86 wherein the hole is of diameter sufficient to enable primary leg axle 82 to slidably pass through the same and to permit support leg 6 to rotate around axle 82.

As mentioned, upright member 4 and primary base member 2 are rotatably connected together by axle 44. Furthermore, axle 82 can be utilized in any one of holes 76, 78 and 80. Consequently, the distance between axle 44 and axle 82 will vary depending upon the angular relationship of upright member 4 and primary base member 2 and the position of axle 82. Thus, primary support leg 6 preferably includes a first length adjusting means, such as turnbuckle 88, intermediate first connecter 84 and second connecter 86 to permit the distance between connecter 84 and connecter 86 to be adjusted to correspond to the distance between axle 44 and axle 82.

Primary base member 2 further comprises front axle 90 removably attached to front surface 37 by means of right angle clips 92 and 94, each of which is attached to surface 37 intermediate left end 40 and right end 42 of base member 2. The first leg of each of clips 92 and 94 is rigidly attached to surface 37 whereby the second leg of each of clips 92 and 94 extends outwardly from, and substantially perpendicular to surface 37. A hole, not shown, penetrates the mentioned second leg of each of clips 92 and 94. The holes in clips 92 and 94 are in alignment, are sized to rotatably receive and support each end of axle 90 and positioned to place axle 90 a constant distance from surface 37 and substantially parallel to upright axle 44.

Referring to FIGS. 2, 3, 5, 6, 7 and 10, frame 1 further comprises secondary base member 8, secondary support leg 10, secondary base axle 96 and secondary leg axle 98.

Figure 2:
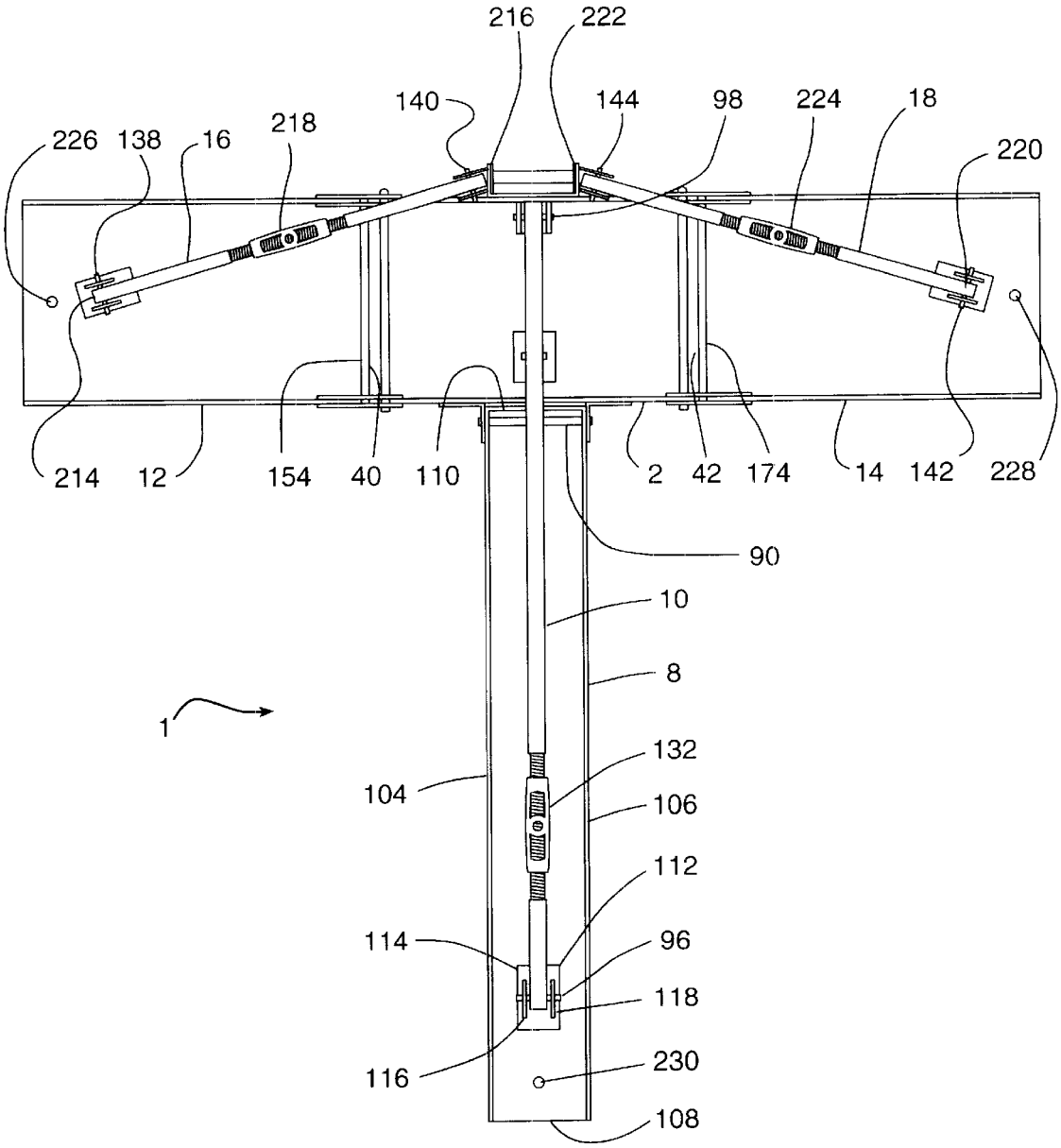
FIG. 2 is the top view of an embodiment of the apparatus of this invention.

Secondary base member 8 is a third workpiece substantially in the shape of a channel having a linear axis, a transverse axis, a web, comprising top surface 100 and bottom surface 102, left flange 104, right flange 106, front end 108 and rear end 110. Rear end 110 is adapted for rotatable attachment to front axle 90. Each of flanges 104 and 106 is substantially parallel to the linear axis of base member 8 and each extends upwardly from and substantially perpendicular to top surface 100. The separation between flanges 104 and 106 is adjusted to enable rear end 110 of member 8 to be slidably placed between the second legs of right angle clips 92 and 94 of base member 2. Aligned holes, not shown, penetrate flanges 104 and 106 adjacent rear end 110 of base member 8 and are sized to rotatably receive and support each end of axle 90. Flanges 104 and 106 at rear end 110 are inserted between clips 92 and 94, the respective holes in clips 92 and 94 and flanges 104 and 106 are placed in alignment and axle 90 is inserted into the holes to thereby rotatably connect secondary base member 8 to primary base member 2. As shown in FIG. 2, axle 90 is then inserted into the thus aligned holes to thereby rotatably connect front side 37 of primary base member 2 to rear end 110 of secondary base member 8. Upon connection of secondary member 8 to primary member 2, it is preferred that the linear axis of member 8 be in alignment with the transverse axis of member 2.

Secondary base axle 96 is positioned substantially parallel to front axle 90, which is parallel to upright axle 44, and is removably attached to and positioned a constant distance from top surface 100 intermediate front end 108 and rear end 110 of member 8 by clip assembly 112 which is rigidly attached to surface 100. Clip assembly 112 is preferably aligned along the linear axis of base member 8 and positioned equidistant between Flanges 104 and 106. Clip assembly 112 is comprised of plate 114 having rigidly attached thereto ears 116 and 118 each of which is parallel to flanges 104 and 106 and each extends upwardly from and substantially perpendicular to plate 114. Hole 120 penetrates ear 116. A similar hole, not shown, in alignment with hole 120 penetrates ear 118. The holes are sized to rotatably receive and support each end of secondary base axle 96 and positioned to place axle 96 a constant distance from surface 100 and substantially parallel to front axle 90 and upright axle 44.

Holes 122, 124 and 126 penetrate rib 74 adjacent distal end 62 of upright member 4. Holes, not shown, which are in alignment with holes 122, 124 and 126 penetrate rib 72. The three aligned pairs of holes, referred to as holes 122, 124 and 126, are adapted to rotatably receive and support secondary leg axle 98 which is adapted to be inserted into and rotatably supported by holes 122, 124 and 126. Secondary leg axle 98 can be, thus, removably attached to front side 64 of upright member 4 intermediate primary leg axle 82 and distal end 62. Axle 98 is positioned a constant distance from front side 64 and substantially parallel to secondary base axle 96 which parallel to upright axle 44.

Secondary support leg 10 is a linear member having third connecter 128 at one end thereof adapted for rotatable connection to secondary base axle 96, and fourth connecter 130 at the other end thereof adapted for rotatable connection to secondary leg axle 98. It is, thus, clear that a hole, not shown, penetrates third connector 128 wherein the hole is of diameter sufficient to enable secondary base axle 96 to slidably pass through the same and to permit support leg 10 to rotate around axle 96. It is also clear that a hole, not shown, penetrates fourth connector 130 wherein the hole is of diameter sufficient to enable secondary leg axle 98 to slidably pass through the same and to permit support leg 10 to rotate around axle 98.

As mentioned, primary base member 2 and secondary base member 8 are rotatably connected together by axle 90. Furthermore, axle 98 can be utilized in any one of holes 122, 124 and 126. Consequently, the distance between axle 96 and axle 98 will vary depending upon the angular relationship of upright member 4 and secondary base member 8 and the position of axle 98. Thus, secondary support leg 10 preferably includes a second length adjusting means, such as turnbuckle 132, intermediate third connecter 128 and fourth connecter 130 to permit the distance between connecter 128 and connecter 130 to be adjusted to correspond to the distance between axle 96 and axle 98.

Referring to FIGS. 2, 4, 5, 12 and 13, frame 1 further comprises left base member 12, right base member 14, left support leg 16, right support leg 18, left axle 134, right axle 136, left base axle 138, left leg axle 140, right base axle 142 and right leg axle 144. Left end 40 of primary base member 2 is rotatably attached to left axle 134. Right end 42 of base member 2 is rotatably attached to right axle 136.

Left base member 12 is a fourth workpiece substantially in the shape of a channel having a linear axis, a transverse axis, a web, comprising upper surface 146, front flange 148, back flange 150, left end 152, right end 154. Left axle 134 is adapted for removable attachment to right end 154 and left base axle 138 is adapted for removable attachment to upper surface 146. Each of flanges 148 and 150 is substantially parallel to the linear axis of base member 12 and each extends upwardly from and substantially perpendicular to upper surface 146. The separation between flanges 148 and 150 is equal to the separation between flanges 36 and 38 of base member 2 such that upon pivotal attachment of base member 12 to base member 2, as described below, flange 148 is in alignment with flange 36 and flange 150 is in alignment with flange 38 and the linear axis of member 12 is in alignment with the linear axis of member 2.

Bracket 156, consisting of parallel plates 158 and 160, is rigidly attached to flange 150 at right end 154 of member 12. The first portion of plate 158 is rigidly attached to the outside surface of flange 150 and the second portion of plate 158 extends beyond flange 150. The extension of plate 158 is penetrated by a hole, not shown, which is sized to rotatably receive an end of axle 134. The first portion of plate 160 is rigidly attached to the inside surface of flange 150 and the second portion of plate 160 extends beyond flange 150. The extension of plate 160 is penetrated by a hole, not shown, which is sized to rotatably receive an end of axle 134 and is in alignment with the mentioned hole in plate 158. Plates 158 and 160 are separated by a gap equal to the width of flange 150.

Bracket 162, consisting of parallel plates 164 and 166, is rigidly attached to flange 148 at right end 154 of member 12. The first portion of plate 164 is rigidly attached to the outside surface of flange 148 and the second portion of plate 164 extends beyond flange 148. The extension of plate 164 is penetrated by a hole, not shown, which is sized to rotatably receive an end of axle 134. The first portion of plate 166 is rigidly attached to the inside surface of flange 148 and the second portion of plate 166 extends beyond flange 148. The extension of plate 166 is penetrated by a hole, not shown, which is sized to rotatably receive an end of axle 134 and is in alignment with the mentioned hole in plate 164. Plates 164 and 166 are separated by a gap equal to the width of flange 148. The holes in plates 158, 160, 162 and 164 are equal in size and are in alignment. Accordingly when the ends of axle 134 are inserted into the holes, as described, axle 134 is perpendicular to the linear axis of member 12.

Left end 40 of flange 36 is adapted to be slidably inserted into the gap between plates 164 and 166. Hole 135 penetrates flange 36 and is adapted to rotatably receive an end of axle 134. Left end 40 of flange 38 is adapted to be slidably inserted into the gap between plates 158 and 160. A hole, not shown, penetrates flange 38 and is adapted to rotatably receive an end of axle 134. Hole 135 and the mentioned hole in flange 38 are in alignment.

Flange 36 and flange 38 are simultaneously slidably inserted into the respective gaps, the various mentioned holes are placed in alignment and axle 134 is then inserted into the holes to thereby pivotally connect member 12 to member 2. Note the gap between right end 154 of member 12 and left end 40 of member 2.

Right base member 14 is a fifth workpiece substantially in the shape of a channel having a linear axis, a transverse axis, a web, comprising upper surface 168, front flange 170, back flange 172, left end 174, right end 176. Right axle 136 adapted for removable attachment to left end 174 and right base axle 142 is adapted for removable attachment to upper surface 168. Each of flanges 170 and 172 is substantially parallel to the linear axis of base member 14 and each extends upwardly from and substantially perpendicular to upper surface 168. The separation between flanges 170 and 172 is equal to the separation between flanges 36 and 38 of base member 2 such that upon pivotal attachment of base member 14 to base member 2, as described below, flange 170 is in alignment with flange 36 and flange 172 is in alignment with flange 38 and the linear axis of member 14 is in alignment with the linear axis of member 2.

Bracket 178, consisting of parallel plates 180 and 182, is rigidly attached to flange 172 at left end 174 of member 14. The first portion of plate 180 is rigidly attached to the outside surface of flange 172 and the second portion of plate 180 extends beyond flange 172. The extension of plate 180 is penetrated by a hole, not shown, which is sized to rotatably receive an end of axle 136. The first portion of plate 182 is rigidly attached to the inside surface of flange 172 and the second portion of plate 182 extends beyond flange 172. The extension of plate 182 is penetrated by a hole, not shown, which is sized to rotatably receive an end of axle 136 and is in alignment with the mentioned hole in plate 180. Plates 180 and 182 are separated by a gap equal to the width of flange 172.

Bracket 184, consisting of parallel plates 186 and 188, is rigidly attached to flange 170 at left end 174 of member 14. The first portion of plate 186 is rigidly attached to the outside surface of flange 170 and the second portion of plate 186 extends beyond flange 170. The extension of plate 186 is penetrated by a hole, not shown, which is sized to rotatably receive an end of axle 136. The first portion of plate 188 is rigidly attached to the inside surface of flange 170 and the second portion of plate 188 extends beyond flange 170. The extension of plate 188 is penetrated by a hole, not shown, which is sized to rotatably receive an end of axle 136 and is in alignment with the mentioned hole in plate 186. Plates 186 and 188 are separated by a gap equal to the width of flange 170. The holes in plates 180, 182,186 and 188 are equal in size and are in alignment. Accordingly when the ends of axle 136 are inserted into the holes, as described, axle 136 is perpendicular to the linear axis of member 14.

Right end 42 of flange 36 is adapted to be slidably inserted into the gap between plates 186 and 188. Hole 137 penetrates flange 36 and is adapted to rotatably receive an end of axle 136. Right end 42 of flange 38 is adapted to be slidably inserted into the gap between plates 180 and 182. A hole, not shown, penetrates flange 38 and is adapted to rotatably receive an end of axle 136. Hole 137 and the mentioned hole in flange 38 are in alignment.

Flange 36 and flange 38 are simultaneously slidably inserted into the respective gaps, the various mentioned holes are placed in alignment and axle 136 is then inserted into the holes to thereby pivotally connect member 14 to member 2. Note the gap between left end 174 of member 14 and right end 42 of member 2.

Left base axle 138 is removably attached to upper surface 146 of left base member 12 by means of clip assembly 190. Clip assembly 190 is rigidly attached to surface 146 at a point intermediate left end 152 and right end 154. Clip assembly 190 is preferably aligned along the linear axis of base member 12, and is comprised of plate 192 having rigidly attached thereto ears 194 and 196, each of which extend upwardly from and, preferably, substantially perpendicular to plate 192. A hole, not shown, penetrates each of ears 194 and 196. The holes in ears 194 and 196 are in alignment, are sized to rotatably receive and support each end of left base axle 138 and positioned to place axle 138 a constant distance from surface 146. Furthermore, clip 190 is positioned on surface 146 so that axle 138 is not parallel or perpendicular to either the linear or the transverse axis of member 12, and so that ears 194 and 196 are positioned to face in the direction of the surface of left flange 68 of upright member 4, as shown, for example, in FIGS. 2 and 3. Ears 194 and 196 are spaced apart by an amount sufficient to permit connecter end 214 of leg 16 to fit between them while being rotatably connected to axle 138.

Right base axle 142 is removably attached to upper surface 168 of right base member 14 by means of clip assembly 198. Clip assembly 198 is rigidly attached to surface 168 at a point intermediate left end 174 and right end 176. Clip assembly 198 is preferably aligned along the linear axis of base member 14, and is comprised of plate 200 having rigidly attached thereto ears 202 and 204, each of which extend upwardly from and, preferably, substantially perpendicular to plate 200. A hole, not shown, penetrates each of ears 202 and 204. The holes in ears 202 and 204 are in alignment, are sized to rotatably receive and support each end of right base axle 142 and positioned to place axle 142 a constant distance from surface 168. Furthermore, clip 198 is positioned on surface 168 so that axle 142 is not parallel or perpendicular to either the linear or the transverse axis of member 14 and so that ears 202 and 204 are positioned to face in the direction of the surface of right flange 70 of upright member 4, as shown, for example, in FIG. 2. Ears 202 and 204 are spaced apart by an amount sufficient to permit connecter end 220 of leg 18 to fit between them while being rotatably connected to axle 142.

Left leg axle 140 is substantially parallel to left base axle 138. In this regard, if upright member 4 is perpendicular to primary base member 2, as shown, for example, in FIGS. 2 and 3, then axle 140 will be parallel to axle 138. Axle 140 is removably attached to the surface of left flange 68 means of clip assembly 206. Clip assembly 206 is rigidly attached to flange 68 at a point intermediate distal end 62 and primary leg axle 82, and, preferably, intermediate distal end 62 and secondary leg axle 98. Clip assembly 206 is comprised of plate 208 having rigidly attached thereto ears 210 and 212, each of which extend upwardly from and, preferably, substantially perpendicular to plate 208. A hole, not shown, penetrates each of ears 210 and 212. The holes in ears 210 and 212 are in alignment, are sized to rotatably receive and support each end of left leg axle 140 and positioned to place axle 140 a constant distance from the surface of flange 68. Furthermore, clip assembly 206 is positioned on flange 68 so that axle 140 is not parallel or perpendicular to either the linear or the transverse axis of member 4 and so that ears 210 and 212 are positioned to face in the direction of ears 194 and 196 of left base member 12 as shown, for example, in FIGS. 2 and 3. Ears 210 and 212 are spaced apart by an amount sufficient to permit connecter end 216 of leg 16 to fit between them while being rotatably connected to axle 140.

Right leg axle 144 is substantially parallel to right base axle 142. In this regard, if upright member 4 is perpendicular to primary base member 2, as shown, for example, in FIGS. 2 and 3, then axle 144 will be parallel to axle 142. Axle 144 is removably attached to the surface of right flange 70 by means of clip assembly 206*a*, not shown, which is similar to clip assembly 206. Clip assembly 206*a* is rigidly attached to flange 70 in alignment with clip assembly 206. Clip assembly 206*a* is comprised of plate 208*a* having rigidly attached thereto ears 210*a* and 212*a*, each of which extend upwardly from and, preferably, substantially perpendicular to plate 208*a*. A hole, not shown, penetrates each of ears 210*a* and 212*a*. The holes in ears 210*a* and 212*a*are in alignment, are sized to rotatably receive and support each end of right leg axle 144 and positioned to place axle 144 a constant distance from the surface of flange 70. Furthermore, clip assembly 206*a* is positioned on flange 70 so that axle 144 is not parallel or perpendicular to either the linear or the transverse axis of member 4 and so that ears 210*a* and 212*a* are positioned to face in the direction of ears 202 and 204 of right base member 14 as shown, for example, in FIG. 2. Ears 210*a* and 212*a* are spaced apart by an amount sufficient to permit connecter end 222 of leg 18 to fit between them while being rotatably connected to axle 144.

Left support leg 16 is a linear member having fifth connecter 214 at one end thereof adapted for rotatable connection to left base axle 138, and sixth connecter 216 at the other end thereof adapted for rotatable connection to left leg axle 140. It is, thus, clear that a hole, not shown, penetrates third connector 214 wherein the hole is of diameter sufficient to enable left base axle 138 to slidably pass through the same and to permit support leg 16 to rotate around axle 138. It is also clear that a hole, not shown, penetrates sixth connector 216 wherein the hole is of diameter sufficient to enable left leg axle 140 to slidably pass through the same and to permit support leg 16 to rotate around axle 140.

As mentioned, primary base member 2 and left base member 12 are rotatably connected together by axle 134, and primary base member 2 and upright member 4 are rotatably connected together by axle 44. Consequently, the distance between axle 138 and axle 140 will vary depending upon the angular relationship of upright member 4 and primary base member 2 and the angular relationship between primary base member 2 and left base member 12. Thus, left support leg 16 preferably includes a third length adjusting means, such as turnbuckle 218, intermediate fifth connecter 214 and sixth connecter 216 to permit the distance between connecter 214 and connecter 216 to be adjusted to correspond to the distance between axle 138 and axle 140.

Right support leg 18 is a linear member having seventh connecter 220 at one end thereof adapted for rotatable connection to right base axle 142, and eighth connecter 222 at the other end thereof adapted for rotatable connection to right leg axle 144. It is, thus, clear that a hole, not shown, penetrates seventh connector 220 wherein the hole is of diameter sufficient to enable right base axle 142 to slidably pass through the same and to permit support leg 18 to rotate around axle 142. It is also clear that a hole, not shown, penetrates eighth connector 222 wherein the hole is of diameter sufficient to enable left leg axle 144 to slidably pass through the same and to permit support leg 18 to rotate around axle 144.

As mentioned, primary base member 2 and right base member 14 are rotatably connected together by axle 136, and primary base member 2 and upright member 4 are rotatably connected together by axle 44. Consequently, the distance between axle 142 and axle 144 will vary depending upon the angular relationship of upright member 4 and primary base member 2 and the angular relationship between primary base member 2 and right base member 14. Thus, left support leg 18 preferably includes a fourth length adjusting means, such as turnbuckle 224, intermediate seventh connecter 220 and eighth connecter 222 to permit the distance between connecter 220 and connecter 222 to be adjusted to correspond to the distance between axle 142 and axle 144.

4. OPERATION OF THE INVENTION

Referring to FIG. 1, proximal end 60 of upright member 4 is rotatably connected to upright axle 44 to form a subassembly which is positioned adjacent to pole 20. Thereafter, an end, not shown, of chain segment 23 having a hook attached thereto is passed over the surface of roller 67 between sides 75 and 77 into cavity 65. Using the mentioned hook in known manner, at least one loop of chain segment 23 is formed around pole 20 at a point intermediate slot combination 74*c* and 72*c* and slot combination 74*b* and 72*b*. Turnbuckle 29 is connected to the other end of chain segment 23.

Flanges 68 and 70 on backside 66 of upright member 4 are placed against pole 20. First connecter 84 is rotatably connected to primary base axle 46. Strap 26 is wrapped around pole 20 and upright member 4 by passing it through slots 72*c* and 74*c*. Strap 26 is then tightened to force flanges 68 and 70 against pole 20. Straps 28 and 30 are similarly installed on pole 20 by use of slots 72*b* and 74*b* and slots 72*c* and 74*c*, respectively. Turnbuckle 88 is then rotated in the manner known in the art to increase or decrease the length of primary support leg 6 to enable the connection of second connecter 86 to primary leg axle 82. Second connecter 86 is then rotatably connected to primary leg axle 82. Turnbuckle 88 is then further rotated to desirably reduce or prevent any rotational movement of upright member 4 relative to primary base member 2 around axle 44. It is to be understood, that it is desirable to rotate turnbuckle 88 by an amount sufficient to cause leg 6 to urge base member 2 against the supporting ground, but it is not desirable to excessively rotate turnbuckle 88 to cause leg 6 to move pole 20.

Then, an end, not shown, of chain segment 25 having a hook attached thereto is passed around pole 20 and upright member 4. Using the mentioned hook in known manner, at least one loop of chain segment 25 is formed around pole 20 and upright member 4 at a point intermediate axle 82 and proximal end 60. Turnbuckle 31 is connected to the other end of chain segment 25. Thereafter, anchor 24 is firmly connected to the ground.

One end of chain segment 27 is then connected to turnbuckle 29. The other end is passed from turnbuckle 29 to turnbuckle 31 through anchor 24 and connected to turnbuckle 31. After chain 27 is connected to turnbuckle 31 one or both of the turnbuckles are rotated in the known manner to tighten member 22. It is evident that chain segment 23 acts linearly on pole 20 to prevent it from sliding on flanges 68 and 70. It is also evident that chain segment 25 acts transversely on pole 20 to urge it against flanges 68 and 70.

Secondary base member 8 is rotatably connected to front axle 90 as described. Third connecter 128 is rotatably connected to secondary base axle 96; turnbuckle 132 is rotated in the manner known in the art to increase or decrease the length of secondary support leg 10 to enable the connection of fourth connecter 130 to secondary leg axle 98; and fourth connecter 130 is rotatably connected to secondary leg axle 98. Turnbuckle 132 is then rotated to desirably reduce or prevent any rotational movement of secondary base member 8 relative to primary base member 2 around axle 90. It is to be understood, that it is desirable to rotate turnbuckle 132 by an amount sufficient to cause leg 10 to urge base member 8 against the supporting ground, but it is not desirable to excessively rotate turnbuckle 132 to cause leg 10 to move pole 20.

Primary base member 2 is rotatably connected to axle 134 as described. Fifth connecter 214 is rotatably connected to left base axle 138. Turnbuckle 218 is rotated in the manner known in the art to increase or decrease the length of left support leg 16 to enable the connection of sixth connecter 216 to left leg axle 140. Sixth connecter 216 is rotatably connected to left leg axle 140. Turnbuckle 218 is then rotated to desirably reduce or prevent any rotational movement of left base member 12 relative to primary base member 2 around axle 134. It is to be understood, that it is desirable to rotate turnbuckle 218 by an amount sufficient to cause leg 16 to urge base member 12 against the supporting ground, but it is not desirable to excessively rotate turnbuckle 218 to cause leg 16 to move pole 20.

Primary base member 2 is rotatably connected to axle 136 as described. Seventh connecter 220 is rotatably connected to right base axle 142. Turnbuckle 224 is rotated in the manner known in the art to increase or decrease the length of right support leg 18 to enable the connection of eighth connecter 222 to right leg axle 144. Eighth connecter 222 is rotatably connected to right leg axle 144. Turnbuckle 224 is then rotated to desirably reduce or prevent any rotational movement of right base member 14 relative to primary base member 2 around axle 136. It is to be understood, that it is desirable to rotate turnbuckle 224 by an amount sufficient to cause leg 18 to urge base member 14 against the supporting ground, but it is not desirable to excessively rotate turnbuckle 224 to cause leg 18 to move pole 20.

Spikes, not shown, can be driven into the ground through holes 226, 228 and 230 in base members 12, 14 and 8, respectively, to help prevent the articulating frame of this invention from moving with respect to the ground.

Having described the invention, that which is claimed is:

1. An apparatus useful for maintaining a column in an upright position, said apparatus comprising a primary base member, an upright member and a primary support leg wherein:

said primary base member is comprised of a first workpiece having a linear axis, a transverse axis, an upper surface, a lower surface, a front surface, a back surface, a left side, a right side, an upright member axle and a primary base axle;

said upright member axle is removably attached to said back surface of said first workpiece positioned a constant distance therefrom, substantially parallel to said linear axis of said first workpiece and intermediate said left side and said right side of said first workpiece;

said primary base axle is removably attached to said upper surface of said first workpiece positioned a constant distance therefrom, substantially parallel to said upright member axle and intermediate said left side and said right side of said first workpiece;

said upright member is comprised of a second workpiece having a first proximal end adapted for rotatable connection to said upright member axle, a first distal end, a front side, a back side, a left surface, a right surface and a primary leg axle;

said primary leg axle is removably attached to said front side of said second workpiece positioned a constant distance therefrom, substantially parallel to said upright member axle and intermediate said first proximal end and said first distal end of said second workpiece;

said primary support leg is comprised of a linear member having a first connecter at one end thereof adapted for rotatable connection to said primary base axle and a second connecter at the other end thereof adapted for rotatable connection to said primary leg axle;

wherein said first proximal end of said second workpiece is rotatably connected to said upright member axle;

said first connecter is rotatably connected to said primary base axle; and said second connecter is rotatably connected to said primary leg axle.

2. The apparatus of claim 1 wherein said linear member of said primary support leg further comprises a first length adjusting means intermediate said first connecter and said second connecter.

3. The apparatus of claim 2 wherein said first workpiece further comprises a front axle removably attached to said front surface thereof, positioned a constant distance therefrom intermediate said left side and said right side and substantially parallel to said upright member axle.

4. The apparatus of claim 3 further comprising a secondary base member, a secondary support leg, and a secondary leg axle wherein:

said secondary base member is comprised of a third workpiece having a top surface, a bottom surface, a rear end adapted for rotatable connection to said front axle, a front end, and a secondary base axle;

said secondary base axle is removably attached to said top surface of said third workpiece positioned a constant distance therefrom, substantially parallel to said upright member axle and intermediate said front end and said rear end of said third workpiece;

said secondary leg axle is removably attached to said front side of said second workpiece positioned a constant distance therefrom, substantially parallel to said upright member axle and intermediate said primary leg axle and said distal end of said second workpiece;

said secondary upright support leg is comprised of a linear member having a third connecter at one end thereof adapted for rotatable connection to said secondary base axle and a fourth connecter at the other end thereof adapted for rotatable connection to said secondary leg axle;

wherein said rear end of said third workpiece is rotatably connected to said front axle of said first workpiece;

said third connecter of said linear member of said secondary upright support leg is rotatably connected to said secondary base axle; and said fourth connecter of said linear member of said secondary upright support leg is rotatably connected to said secondary leg axle.

5. The apparatus of claim 4 wherein said linear member of said secondary upright support leg further comprises a second length adjusting means intermediate said third connecter and said fourth connecter.

6. The apparatus of claim 5 further comprising a left base member, a right base member, a left support leg, a right support leg, a left leg axle and a right leg axle;

said left base member is comprised of a fourth workpiece having a top surface, a bottom surface, a first left end, a first right end, a left axle and a left base axle;

said left axle is removably attached to said first right end of said fourth workpiece and substantially perpendicular to said linear axis of said first workpiece, wherein said left side of said first workpiece is adapted for rotatable connection to said left axle;

said left base axle is removably attached to said top surface of said fourth workpiece positioned a constant distance therefrom, substantially parallel to said top surface of said fourth workpiece intermediate said left axle and said first left end of said fourth workpiece;

said right base member is comprised of a fifth workpiece having a top surface, a bottom surface, a second left end, a second right end, a right leg axle and a right axle;

said right axle is removably attached to said second left end of said fifth workpiece and substantially perpendicular to said linear axis of said first workpiece, wherein said right side of said first workpiece is adapted for rotatable connection to said right axle;

said right base axle is removably attached to said top surface of said fifth workpiece positioned a constant distance therefrom, substantially parallel to said top surface of said fifth workpiece intermediate said right axle and said second right end of said fifth workpiece;

said left support leg is comprised of a linear member having a fifth connecter at one end thereof adapted for rotatable connection to said left base axle and a sixth, connecter at the other end thereof adapted for rotatable connection to said left leg axle positioned on said left surface of said second workpiece intermediate said proximal end of said second workpiece and said primary leg axle;

said right support leg is comprised of a linear member having a seventh connecter at one end thereof adapted for rotatable connection to said right base axle and an eighth connecter at the other end thereof adapted for rotatable connection to said right leg axle positioned on said right surface of said second workpiece intermediate said proximal end of said second workpiece and said primary leg axle; and further wherein said left side of said first workpiece is connected to said left axle;

said fifth connecter is connected to said left base axle;

and sixth connecter is connected to said left leg axle;

said right side of said first workpiece is connected to said right axle;

said seventh connecter is connected to said right base axle; and said eighth connecter is connected to said right leg axle.

7. The apparatus of claim 6 wherein said linear member of said left support leg further comprises a third length adjusting means intermediate said fifth connecter and said sixth connecter, and said linear member of said right upright support leg further comprises a fourth length adjusting means intermediate said seventh connecter and said eighth connecter.

8. The apparatus of claim 7 further comprising a line axle removably attached to said second workpiece at said fist distal end, substantially parallel to said secondary leg axle and intermediate said left surface and said right surface of said second workpiece.

9. The apparatus of claim 8 wherein said line axle is a roller.

10. An apparatus for maintaining a column in an upright position, said apparatus comprising an articulated ground support member, an upright member and a plurality of stiffening members;

said articulated ground support member is comprised of a primary base member, a left base member, a right base member and a secondary base member, wherein said primary base member, said left base member, and said right base member are flexibly joined end-to-end to form a linear hinged structure having a first longitudinal axis, a left side, a right side, a front side, a back side, an upper surface and a lower surface;

said secondary base member, having a second longitudinal axis, a front end and a rear end, is flexibly joined at said rear end thereof to said front side of said linear hinged structure intermediate said left side and said right side thereof, whereby said longitudinal axis of said secondary base member is substantially perpendicular to said longitudinal axis of said linear hinged structure to thereby form said articulated ground support member;

said upright member, having a third longitudinal axis, a proximal end, a distal end, a left surface, a right surface, a base member side and a column side, is flexibly joined on said base member side at said proximal end thereof to said back side of said linear hinged structure intermediate said left side and said right side thereof;

said plurality of stiffening members are comprised of a primary leg, a secondary leg, a left leg and a right leg;

said primary leg, having a first length adjusting means, a primary base member connecter and a first upright member connecter, is rotatably connected by said primary base member connecter to said upper surface of said primary base member, and by said first upright member connecter to said base side of said upright member adjacent said proximal end thereof;

said secondary leg, having a second length adjusting means, a secondary base member connecter and a second upright member connecter, is rotatably connected by said secondary base member connecter to said secondary base member adjacent said front end thereof, and by said second upright member connecter to said base side of said upright member adjacent said distal end thereof;

said left leg, having a third length adjusting means, a left base member connecter and a third upright member connecter, is rotatably connected by said left base member connecter to said upper surface of said linear hinged structure at said left side thereof, and by said third upright member connecter to said left surface of said upright member adjacent said distal end thereof; and said right leg, having a fourth length adjusting means, a right base member connecter and a fourth upright member connecter, is rotatably connected by said right base member connecter to said upper surface of said linear hinged structure at said right side thereof, and by said fourth upright member connecter to said right surface of said upright member adjacent said distal end thereof.

* * * * *